US007168424B1

(12) United States Patent
Wing

(10) Patent No.: US 7,168,424 B1
(45) Date of Patent: Jan. 30, 2007

(54) SLING-SHOT RIFLE

(76) Inventor: Stan Wing, 7919 Wing La., Sedro Woolley, WA (US) 98284

( * ) Notice: Subject to any disclaimer, the term of this patent is extended or adjusted under 35 U.S.C. 154(b) by 31 days.

(21) Appl. No.: 11/099,898

(22) Filed: Apr. 5, 2005

(51) Int. Cl.
*F41B 3/02* (2006.01)

(52) U.S. Cl. ..... 124/20.1

(58) Field of Classification Search ..... 124/20.1, 124/20.2, 20.3, 25
See application file for complete search history.

(56) References Cited

U.S. PATENT DOCUMENTS

| | | | | |
|---|---|---|---|---|
| 437,605 | A | | 9/1890 | Kelley |
| 440,538 | A | | 11/1890 | Wilkins |
| 675,534 | A | | 6/1901 | Bruton |
| 1,188,027 | A | | 6/1916 | Widdup |
| 1,606,609 | A | | 11/1926 | Wheeler |
| 2,638,885 | A | | 5/1953 | Keadle |
| 3,857,379 | A | | 12/1974 | Burghardt |
| 3,949,729 | A | | 4/1976 | Pfotenhauer |
| 4,050,438 | A | | 9/1977 | Pfotenhauer |
| 4,278,065 | A | * | 7/1981 | Wales ..... 124/20.1 |
| 4,784,106 | A | * | 11/1988 | Kees ..... 124/20.1 |
| 4,852,543 | A | * | 8/1989 | Mosser ..... 124/20.1 |
| 5,431,145 | A | * | 7/1995 | Strait et al. ..... 124/17 |
| 5,551,412 | A | * | 9/1996 | Warnke ..... 124/20.1 |
| 5,579,749 | A | | 12/1996 | Wilkinson |
| 5,619,978 | A | | 4/1997 | Flournoy |
| 6,564,787 | B1 | | 5/2003 | Barry |

* cited by examiner

*Primary Examiner*—John A. Ricci
(74) *Attorney, Agent, or Firm*—Michael F. Hughes; Hughes Law Firm, PLLC

(57) ABSTRACT

A projectile launching device having at least first and second elastic members that are attached to a projectile pocket where a tong member is adapted to grasp the projectile pocket with the projectile therein and reposition the projectile pocket rearwardly to store energy within the first and second elastic members. The tong member is adapted to be mounted to the base frame of the projectile launching device where the projectile is positioned in a substantially consistent manner from shot to shot and active involvement is required by the shooter to maintain the projectile launching device in a stored energy state.

18 Claims, 7 Drawing Sheets

SLING-SHOT RIFLE

BACKGROUND OF THE INVENTION a) Field of the Invention

In general, projectile launching devices have been well-known and vary tremendously in design and basic operating function. Of course stored energy in members that are stretched having elastic properties has been a standard means for propulsion of a projectile object. The more modern method of projectile launching is employing expanding gases, which is used in firearms to project a bullet down a rifle barrel. However, it is advantageous to utilize propulsion by way of stored energy in elastic members for various reasons.

Regulations placed upon firearms are ever-increasing, and further, there is a certain amount of liability in storing and keeping a firearm readily accessible. In general, a firearm has a primer of some sort to activate the gun powder to produce expanding gases. Further, firearms are generally quite noisy and the report from a gunshot can at times be undesirable.

However, there is a need for a projectile launching device that is accurate and can deliver sufficient foot-pounds of energy in the terminal ballistics of the projectile to kill small rodents in a setting such as a farm. As shown below, the embodiments are adapted to provide for a highly accurate, relatively powerful slingshot device where there is a lower likelihood of accidental discharge for reasons described below.

b) Background Art

In general, the background art shows a variety of slingshot and crossbow-like devices which are described below.

U.S. Pat. No. 6,564,787 (Barry) shows a slingshot device incorporating a laser pointing device. FIG. 4 shows the adjustment system for altering the pitch of the laser beam in the vertical plane. FIG. 7 of this disclosure shows the trigger release mechanism in a cross-sectional view. The mechanism is in a cocked ready-to-fire position whereby the trigger is pivotally mounted about the pinion. Two metal ball bearings are embedded within the recess area between the rigid members as shown in FIG. 8. As seen in this figure, when the trigger is depressed rearwardly and compresses spring, the upper portion of the trigger forces the elastic retainer extension forward and the ball bearings as shown in FIG. 8 move outwardly, allowing the flexible cord to be released. Therefore, it can be appreciated that the release mechanism can remain in a cocked position without the shooter actively retaining it in such a position.

U.S. Pat. No. 5,619,978 (Flournoy) shows a slingshot apparatus that as shown in FIG. 2, the user's offhand arm is positioned within a cradle. Therefore, the clockwise torque caused by pulling the projectile carrying pouch is counter-acted by a counter-clockwise torque by grasping the handle near cross member and a laterally inward force upon the pressure distributing member as shown in FIG. 3. The pouch appears to be a common slingshot type pouch which is only held by the fingers of the shooter.

U.S. Pat. No. 5,551,412 (Warnke) shows a vertically orientated slingshot type device where the slingshot members remain in a substantially vertical plane. FIG. 6 is a side view of the trigger mechanism. The trigger is pivotally connected to the handgrip by the pin. Depressing the trigger rearwardly biases the pin to move downwardly. In its extended state, the pin extends vertically above the plate. As shown in FIG. 5, the lanyard is in a cocked position extending around the pin.

U.S. Pat. No. 4,784,106 (Kees) shows a slingshot whereas shown in FIG. 6, the projectile pellet is positioned between pins that are shown in the partial sectional view of FIG. 5 taken along the longitudinal axis of the apparatus. Now referring to FIG. 4, as the plunger is depressed rearwardly, the lower portion of the pins engage the narrow neck region, allowing the upper portions of the pins to expand as shown as the hatched lines in FIG. 5. Thereafter, the pellet projectile as best shown in FIG. 6 is released.

U.S. Pat. No. 4,050,438 (Pfotenhauer) shows a slingshot device that as best shown in FIG. 5 has pulleys to allow for a greater extension of the elastic cord as shown in FIG. 2.

U.S. Pat. No. 5,579,749 (Wilkinson) shows a slingshot like device to launch water balloons. As shown in FIG. 2, apparently, the trigger pivots about the pin. The safety pin extends laterally and prevents an accidental discharge. Apparently, the web is attached to the notch. As described in column 3 of the specification, the shooter then displaces the pin laterally inwardly and depresses the trigger. FIG. 6 shows a second release embodiment whereby detaching the cord from slot allows the projectile to be released. FIG. 7 illustrates another embodiment where apparently depressing the trigger releases the web. FIG. 8 shows a trigger mechanism to release two water balloons.

U.S. Pat. No. 3,949,729 (Pfotenhauer) shows a slingshot like dart-gun whereby as illustrated in FIGS. 2 and 3, the dart is within the slot and propelled by the impact plunger. The release mechanism appears to be that of a common slingshot.

U.S. Pat. No. 3,857,379 (Burghhardt) shows a slingshot device whereby as illustrated in FIG. 4, depressing the trigger provides for a counter clockwise movement, allowing the stem to be positioned downwardly. As shown in FIG. 1, this allows the swing rod to release the pouch. As shown in FIG. 5, two rods are employed and have a lateral width less than the projectile contained in the pouch.

U.S. Pat. No. 2,638,885 (Keadle) discloses a slingshot like device rifle whereas shown in FIG. 2, the projectile is held within the gripping jaws. When the projectile is locked between the jaws, the shooter pulls the handle rearwardly as indicated by the hatched line in the lower left-hand portion. As shown in FIG. 3, the fairly complex trigger mechanism is adapted to move the arm, allowing the jaws to collapse in a rearward portion whereby the pivoting action about the breach block allows for the forward portion of the jaws to open up and allow the projectile to release.

U.S. Pat. No. 1,606,609 (Wheeler) discloses a slingshot like device having a common release mechanism where the projectile is held by the fingers of the shooter.

U.S. Pat. No. 1,188,027 (Widdup) discloses a slingshot like device where the pouch is held by the pin as shown in FIG. 1.

U.S. Pat. No. 440,538 (Bruton) discloses a slingshot like gun whereby as shown in FIG. 1, there is a rather complex trigger mechanism. As shown in FIG. 1, the jaws are in a closed position which is adapted to have a projectile held therein. Now referring to FIG. 2, it can be seen that the forwardmost portion of the trigger has a seer-like engagement with the element that is apparently attached to a pin. Therefore, referring back to FIG. 1, when the trigger is depressed the pin is allowed to reposition forwardly causing the forward portions of the jaws F and F' to open, releasing the projectile.

U.S. Pat. No. 675,534 (Wilkins) shows a spring loaded gun whereby the complex trigger mechanism is comprised of the trigger, a seer, and a latch. Apparently, depressing the trigger to a position as indicated by the hatched line repositions the seer vertically whereby the latch can rotate clockwise to a position as indicated by the hatched line in FIG. 1, therefore releasing the projectile pouch.

U.S. Pat. No. 437,605 (Kelley) shows a slingshot device whereby the isometric view in FIG. 4 shows vertically extending elements rigidly attached to the lower plate portion. When the seer engagement member d moves forwardly in a manner indicated by the hatched line in a cross-sectional view of FIG. 1, the lower plate and the vertical elements are adapted to rotate about the pivot point 'i' to release the projectile.

In general, the prior art as described above teaches projectile launching devices that are adapted to have relatively complex trigger mechanisms to store energy within the device. This is potentially a hazard, in that allowing a projectile launching device to store the energy without active involvement by the user only courts disaster, whereby a prior art projectile launching device can essentially sit in the corner with a tremendous amount of stored energy that may be accidentally discharged. This is a hazard, and the embodiments as described below are adapted to mandate active involvement by the shooter to maintain a stored energy state of the projectile launching device.

SUMMARY OF THE DISCLOSURE

In general the disclosure set out below describes a projectile launching device comprising a base frame having a forward region and a stock region positioned in a longitudinally rearward region. The base frame having a propulsion area having a propulsion pocket connected to first and second elastic members, the first and second elastic members in turn being attached to a base support that is attached to the base frame. There is a surface defining an opening positioned in the longitudinally rearward portion of the base frame. A tong unit is provided having first and second tong members pivotally attached to one another whereby a longitudinally forward region of the pivot attachment. The first and second tong members defining a cradle region, positioned rearwardly of the pivot attachment is an extension on the second tong member and an engagement and release surface positioned laterally outwardly of the first tong member. The tong unit further comprising a locking member that extends vertically downwardly.

The locking member is adapted to engage in the opening of the base frame whereby the cradle region is adapted to engage the outer surface of the propulsion pocket with a projectile contain therein and the shooter must engage active pressure upon the engagement and release surface of the first tong to maintain the projectile launching device in a stored energy state.

BRIEF DESCRIPTION OF THE DRAWINGS

FIG. 11 shows a second embodiment that is adapted to launch a larger projectile such as a tennis ball, racquetball or the like;

DETAILED DESCRIPTION OF THE PREFERRED EMBODIMENTS

Figure 1:
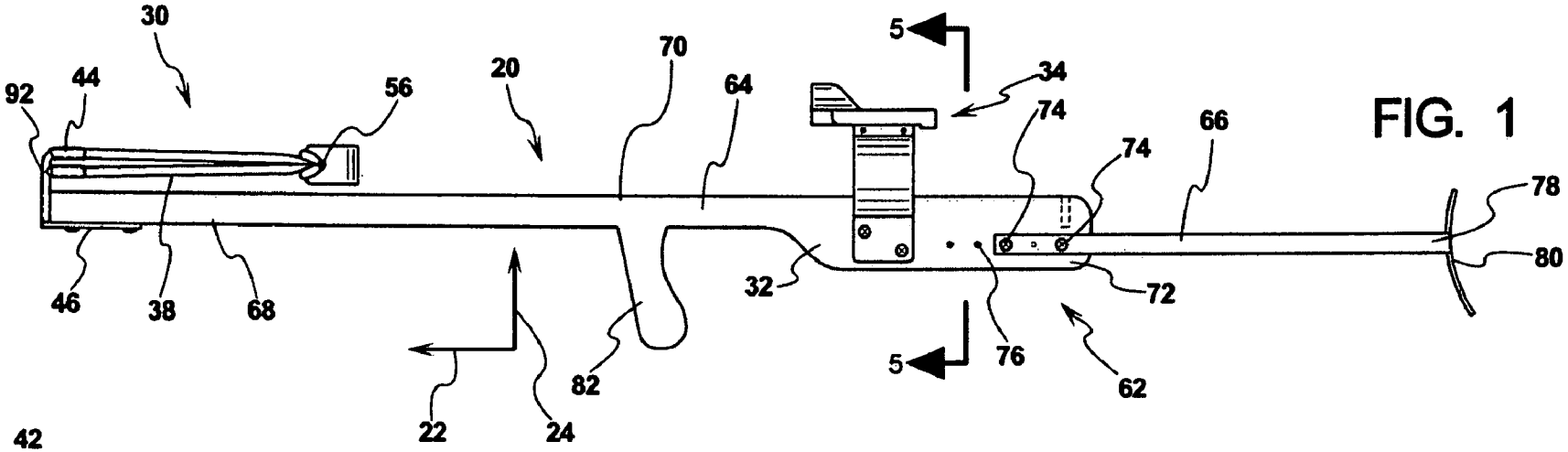
FIG. 1 discloses a side view of the projectile launching device.
Figure 2:
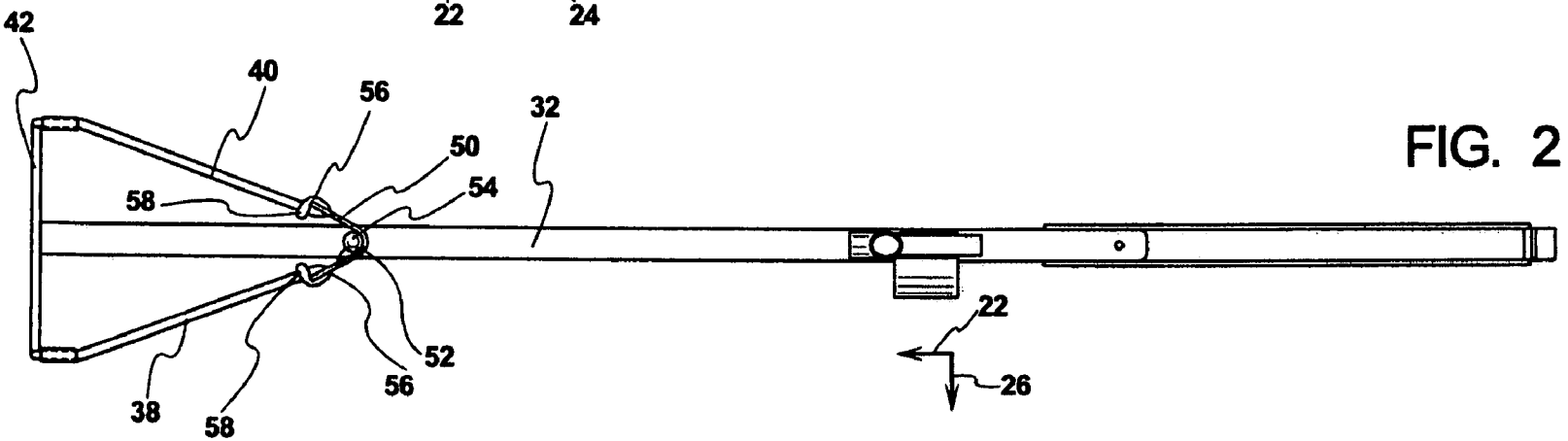
FIG. 2 discloses a top view of a projectile launching device.

As shown in FIG. 1, there is a projectile launching device 20. To aid in the description of the projectile launching device 20, an axes system is shown in FIGS. 1 and 2 whereby the arrow 22 indicates a longitudinal direction and 24 indicates a vertical direction. As shown in FIG. 2, the arrow 26 indicates a lateral direction.

Figure 7:
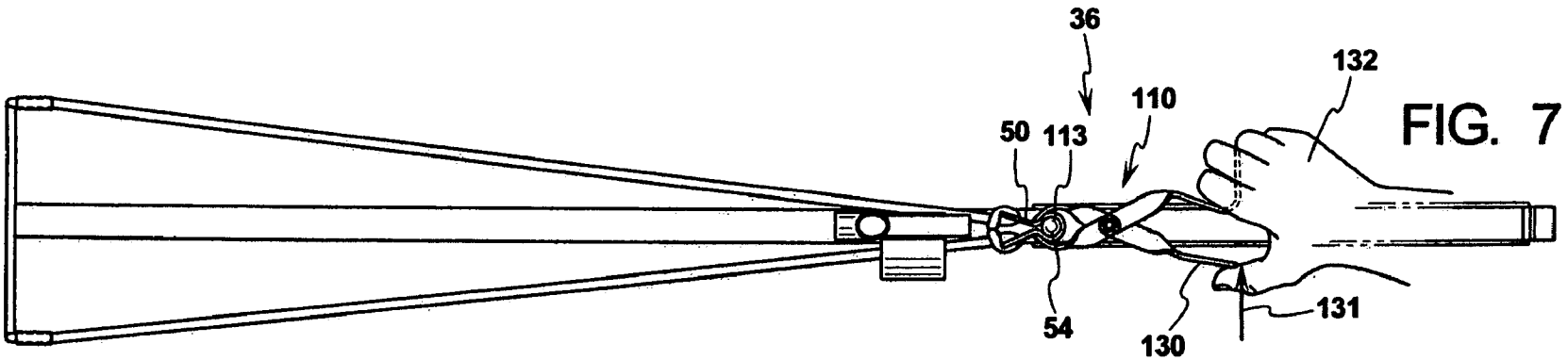
FIG. 7 shows the repositioning of the tong member and the propulsion area to position the projectile launching device in a high energy state.

In general, as shown in FIG. 1, the projectile launching device comprises a propulsion area 30, a base frame 32, a sighting system 34, and as shown in FIG. 7, a release system 36.

The propulsion area 30, as shown in FIGS. 1 and 2, comprises first and second elastic members 38 and 40. As shown in FIG. 1, in one form the elastic members can be comprised of two elastic members to provide additional thrust for the projectile.

The first and second elastic members are attached to a base support 42 that has longitudinally rearward extending members 44 that are adapted to have the first and second elastic members wrapped therearound in the central chamber regions thereof. In general, in a preferred form, the first and second elastic members 38 and 40 consist of common surgical tubing which is widely used for slingshots and the like. As described further herein, an increase of force and essentially a higher spring constant of the first and second elastic members can be employed when the release system 36 as shown in FIG. 7 is employed.

Referring back to FIG. 1, the base support 42 has a frame attachment area 46 that is adapted to be rigidly mounted to the base frame 32. The propulsion area 30 further comprises a propulsion pocket 50 that as shown in FIG. 2 has a forward surface 52 that is adapted to house a projectile 54 therein. In one form, the propulsion pocket (pouch) 50 has a surface defining laterally positioned openings 56 that are adapted to have the first and second elastic members extend therethrough. In a preferred form, the first and second elastic members are each formed of a single piece of surgical tubing, where a loop 58 is formed and extends through the laterally positioned openings 56. This has the effect of locking the surgical tubing to the propulsion pocket 50 and further allows for easy removal and replacement if necessary of the first and second elastic members 38 and 40. Of course various numbers of tubing lengths can be employed and well known foreseeable elastic members can operate as the elastic members.

The base frame 32 comprises a support region 62 which is adapted to interface with the shooter to allow for proper handling of the projectile launching device 20. In one form, the base frame 32 has a base member 64 and a stock region 66. The base member 64 comprises a forward region 68, a central region 70, and a rearward region 72. In one form, the stock region 66 is attached to the rearward region 72 of the base member 64 by way of laterally extending fasteners 74. Positioned in the rearward region 72 can be surfaces defining a plurality of laterally extending openings 76 to provide for a lengthwise adjustment of the stock region 66.

The stock region 66 has a rearward portion 78 that defines a shoulder engagement surface 80 that is adapted to engage the shoulder of the shooter when shooting and drawing the propulsion area into a stored state of energy.

The base member 64 further comprises a handle 82 that is positioned in the central region 70 and is adapted to be grasped by the shooter for manipulating the projectile launching device 20. It should be noted that having the base frame 30 be comprised of a base member 64 and a stock region 66 that are removable and adapted to be fixedly attached to one another is advantageous in that it allows the unit to be broken down into a smaller net volume for shipping purposes.

Figure 5:
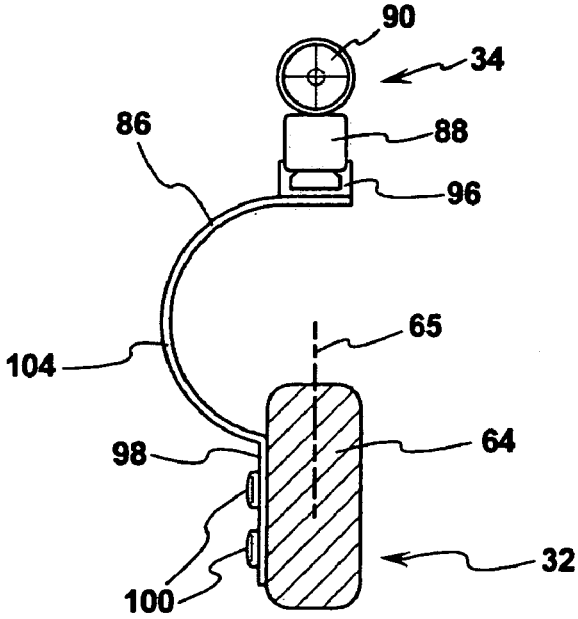
FIG. 5 is a sectional view taken along line 5—5 of FIG. 1 showing the mounting of the red dot scope.

There will now be a discussion of the sighting system 34 with initial reference to FIG. 5. As shown in FIG. 5, the sighting system 34 comprises a base mount 86 and, in a preferred form, a multi-positional scope better known as ared dot sighting system 88. The red dot sighting system 88 essentially removes the need for perfect sight alignment between two fixed points in a sighting system. In other words, a red dot scope provides a first point that is a projected laser that is adapted to hit the screen 90. The screen 90 is a concave screen that provides a plurality of potential second points for proper sight alignment. The red dot which is projected on the screen 90 will essentially stay on the target, assuming the projectile launching device 20 is roughly in line with the target. Red dot scopes are a common sighting system now employed with firearms, archery, air guns, and the like. Although they are commonly referred to as "red dot" scopes, there is no absolute requirement that the projected dot must be a red one in the electromagnetic spectrum of the laser. At present there are other types of "red dot scopes" that have light sources that emit a green light. Therefore a "red dot sighting system/scope" or multi-positional scope is defined broadly as any optical scope that does not require regular notch and post or cross hair sight alignment by the shooter. It should be noted that given the light recoil of the projectile launching device 20, the red dot sighting system 88 can be an off-the-shelf item that is used in air guns. For example, one such suitable device is the Daisy model Accu-Laser® Sight which is particularly well-suited for this application. The base mount 86 has a first mounting region 96 that is adapted to have the red dot sighting system 88 be mounted thereto. The base mount 86 further has a second mounting region 98 that is adapted to be fixedly attached to the base frame 32, and more specifically the base member 64 by way of the fasteners 100. It should be noted that the base member 64 in one form is made of wood, which is conducive to have frictionally engaged wood screws attach components thereto. The base member 86 has a connecting region 104 that is positioned between the first and second mounting regions 96 and 98. In general, the connecting region 104 as shown in FIG. 5 is positioned laterally from the center axis 65 of the base member 64. The connecting region 104 is adapted to position the red dot sighting system 88 vertically above the projectile 54 when in the cocked position and still allow free travel of the first and second elastic members 38 and 40 thereunder.

Figure 3:
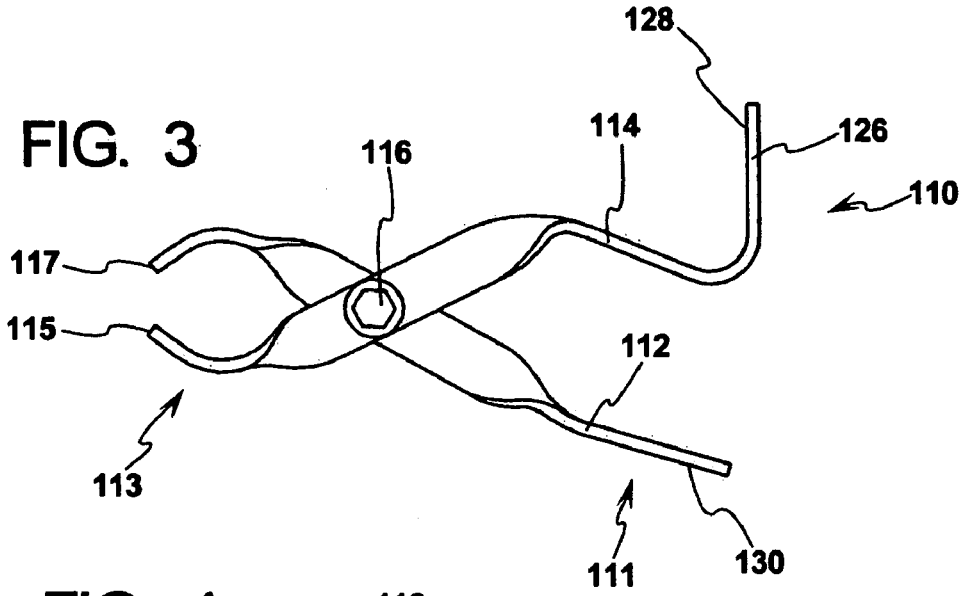
FIG. 3 discloses a tong unit adapted to release a projectile and mandate active pressure upon the projectile by the user while the projectile launching device is in an active energy state.
Figure 4:
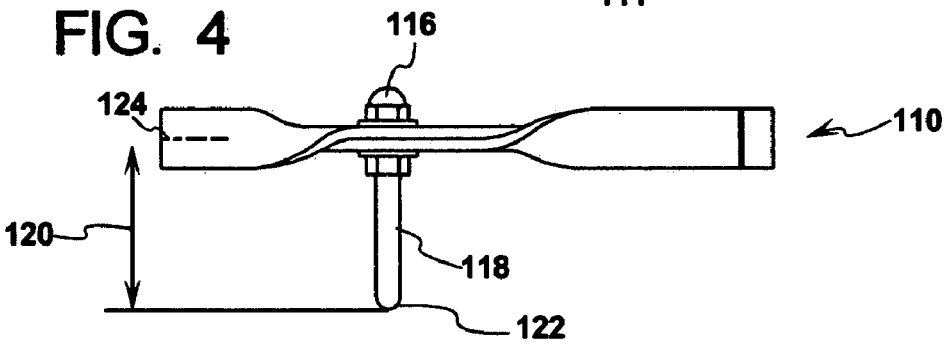
FIG. 4 discloses a side view of the tong unit illustrating the alignment depth of the lower surface of the substantially vertically aligned locking member.

There will now be a discussion of the release system 36 with initial reference to FIGS. 3 and 4. In a preferred form, the release system 36 comprises a containment and release mechanism that requires active engagement where in one form it is a tong unit 110 having first and second tong members 112 and 114. The tong unit 110 has a grasping region 111 and a cradle region 113. The first and second tong members are pivotally connected at the center region 116 by the locking member. The locking member 118 has a defined height 120 as shown in FIG. 4 from the bottom-most surface 122 of the locking member to the approximate vertically aligned central region 124. In general, a vertically aligned central region 124 is the approximate area where the center line of the projectile 54 is positioned when they projectile launching device 20 is fired. As described further below, the release system 36 can provide consistently accurate releases of the projectile 54 in a manner so the projectile launching device 20 is surprisingly accurate, as well as quite powerful.

Figure 6:
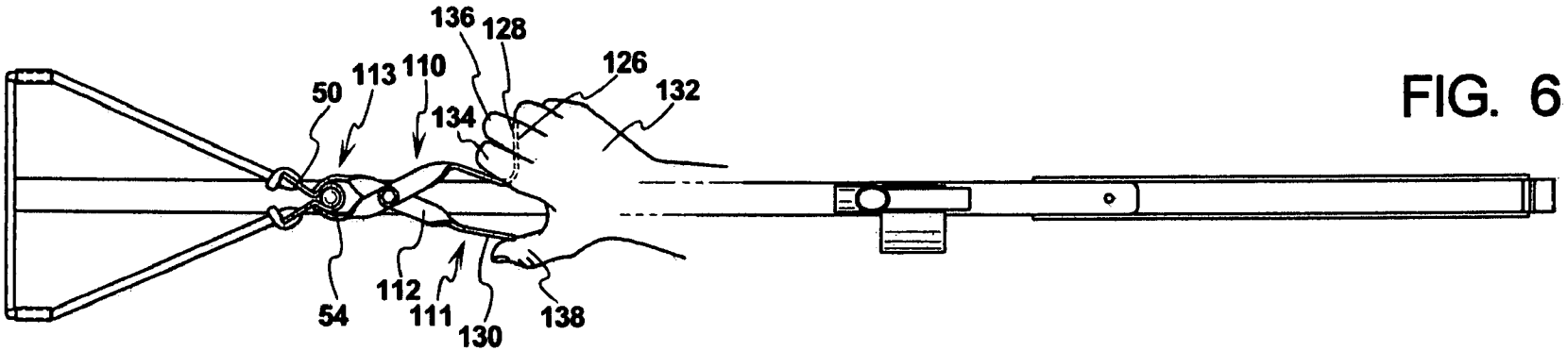
FIG. 6 shows a method of grabbing a projectile with the tong member.

The grasping region 111 comprises an extension 126 having a forward surface 128 that is adapted to be grasped by the second and third phalanges of the shooter. In other words, as shown in FIG. 6, the extension 126 is adapted to be grasped by the index finger and middle finger, and with smaller hands, perhaps the ring finger as well. The forward surface 128 of the extension 126 essentially allows for a loadbearing surface to exert a substantial amount of pull thereon. Located on the first tong member 112 in the grasping region 111 of the tong unit 110, is an engagement and release surface 130 that, as shown in FIG. 6, is adapted to engage the thumb 138 of the shooter. It should be noted that the locking member 118 in one form is threaded at the juncture 160. If a left-handed user owns the projectile launching device 20, he or she can unscrew the locking member 118 and extend it in the opposite direction as that as shown in FIG. 4 whereby the extension 126 will be on the opposite lateral side as that as shown in FIG. 3.

There will now be a description of the method of use of the projectile launching device 20 with initial reference to FIGS. 6 and 7. As shown in FIG. 6, there is a first step in the cocking procedure whereby the shooter's hand 132 grasps the grasping region 111 of the tong unit 110. More specifically, in one form, the index and middle FIGS. 134 and 136 engage the extension 126 and more specifically exert a rearward thrusting force upon the forward surface 128. The thumb 138 presses against the engagement and release surface 130 of the first top member 112 to apply laterally inward force in the cradle region 113. Prior to applying a substantial amount of force on the engagement and release surface 130, a projectile 54 is placed in the propulsion pocket 50 and the cradle region is grasped therearound. It should be noted that the projectile 54 generally has a lateral width that is greater than the forwardmost regions 115 and 117 of the cradle region 113 (see FIG. 3). Therefore, a modest amount of pressure upon the engagement and release surface 130 will generally hold the projectile 54 therein. Of course, there is a mechanical advantage in positioning the pivot location 116 further away from the engagement and release surface and closer to the forward portions 115 and 117, thereby having a lever-like action upon the propulsion pocket 50 to hold the projectile 54 therein.

Figure 8:
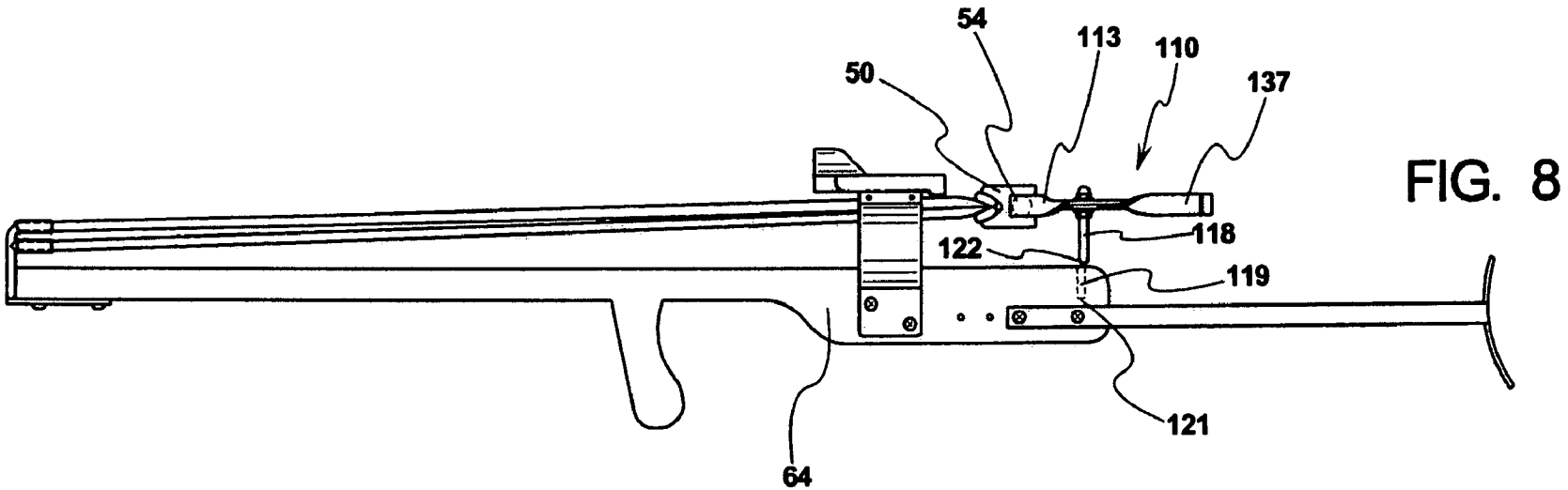
FIG. 8 shows the tong member with the locking member positioned vertically above a positioning hole within the base frame.

It should further be noted that it is desirable to have a consistent positioning upon the propulsion pocket 50 with respect to the cradle region 113. In other words, as shown in FIG. 8, it is desirable to have the projectile 54 positioned substantially in the center region of the propulsion pocket 50 in the vertical direction. Further, it is desirable to have the cradle region 113 of the tong unit 110 substantially vertically centered in the propulsion pocket 50 to give consistent shot-by-shot results. Of course other positions and orientations can be employed of as long as the shooter is consistent from shot to shot.

Now referring back to FIG. 7, the shooter repositions his hand 132 rearwardly while maintaining a lateral inward pressure upon the engagement and releasd surface 130, as indicated by the force vector 131. It should be noted that when drawing the propulsion package 50, the user must have an active state of awareness to keep the projectile 54 locked within the cradle region 113 of the tong unit 110. It should be noted that this process is somewhat intuitive, in that in the early stages of the draw closer to the position as shown in FIG. 6, as the hand positions rearwardly, if the user does not have sufficient force laterally inwardly as indicated by the force vector 131 in FIG. 7, then the propulsion pocket 50 will essentially slip out of the cradle region 113. Of course in the early stage of a draw there is less force exerted upon the projectile 54, and less stored energy within the propulsion area 30. Therefore, injury is very unlikely during this "training" of the shooter. When the shooter realizes that he must apply active pressure upon the engagement and release surface 30, he can then continue the pull of his hand 132 rearwardly with respect to the projectile launching device 20 to position the tong unit 110 into a locked position.

Figure 9:
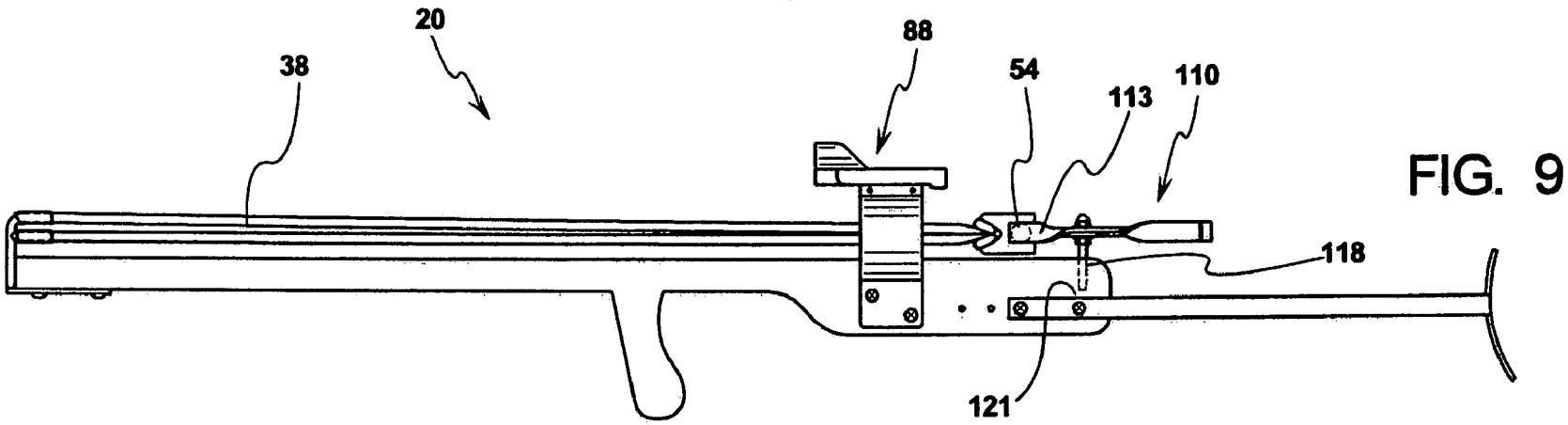
FIG. 9 shows the tong member locked within the positioning hole whereby the projectile launching device is in a potential energy state where active involvement of the user (not shown) must be maintained to preserve the state.

Now referring to FIGS. 8 and 9, it should first be noted that these figures do not show the hand 132 (as shown in FIGS. 6 and 7) for purposes of clarity only. It should be strongly noted that in operation, the hand 132 is actively grasping the tong unit 110 when positioning the tong unit 110 into a locked position. As shown in FIG. 8, while the user has active pressure upon the engagement and release surface 130, he positions the locking member 118 above the surface defining the opening which defines a receiving location 119. The opening 119 has a lower surface 121 that is adapted to engage the lower surface 122 of the tong member 110 as shown in FIG. 4. In one form, the opening 119 can simply be drilled out of the base member 64 to a prescribed depth.

Once the locking member 118 is positioned above the opening 119, the shooter repositions the tong unit 110 downwardly therein as shown in FIGS. 8 and 9.

When the projectile launching device 20 is in the orientation as shown FIG. 9, it should be reiterated that active involvement by the shooter is required to put forth a laterally inward force of the grasping region 111. Of course other mechanisms can be used in place of the tong unit 110, such as a tong unit with two pivot locations 116 whereby a similar type of grasping unit would be repositioned outwardly to maintain and lock the cradle region 113. The important aspect is that the user must actively apply pressure to the tong unit 110 to keep the projectile launching device 20 in the stored energy state as shown in FIG. 1. When the shooter desires to released the projectile 54, he merely releases pressure upon the engagement and release surface 130, thereby allowing the forward-most surface of the projectile 54 to pry apart the cradle region 113 of the tong unit 110. This allows the projectile to accelerate longitudinally forwardly as the first and second elastic members 38 and 40 propel the propulsion package 50 forward.

It should be noted that the red dot sighting system 88 generally has the ability of adjusting for windage and elevation. In other words, if the projectile is consistently hitting 3 inches left at 50 yards, the windage adjustment of the red dot sighting system 88 can move the projection of the laser beam with respect to the surface 90 as shown in FIG. 5 to properly sight in the projectile launching device 20. Of course, with regard to the sighting of the elevation, the user can pick a mean distance such as 30 yards, sight in, and be aware of the "dope" of the projectile, given its velocity and ballistic coefficient where the shooter can aim slightly higher or lower depending upon the distance to the target.

Figure 10:
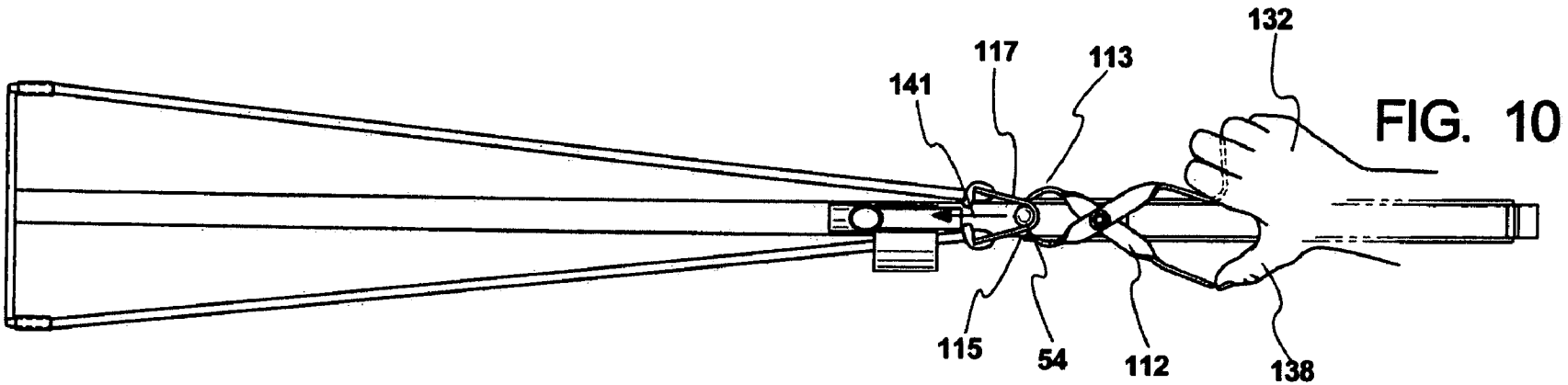
FIG. 10 shows the method of releasing the tong member and allowing the projectile to accelerate forward by the first and second elastic members.

As shown in FIG. 10, it can be seen how the thumb 138 of the shooter's hand 132 has essentially released the first tong member 112, thereby allowing the forward-most portions 115 and 117 of the cradle region 113 to pry open. At this point, the projectile 54 will accelerate forwardly as indicated by the arrow 141.

Figure 11:
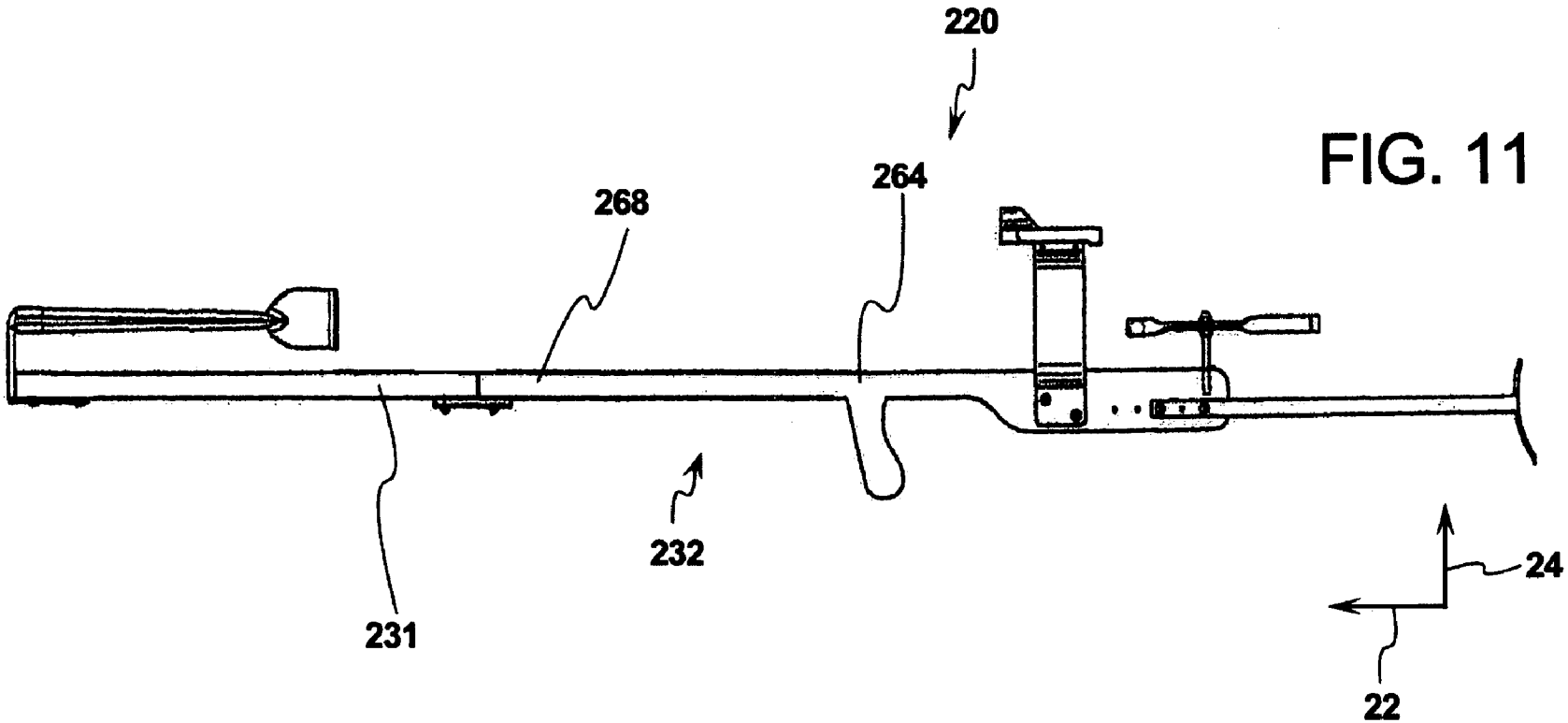
Figure 12:
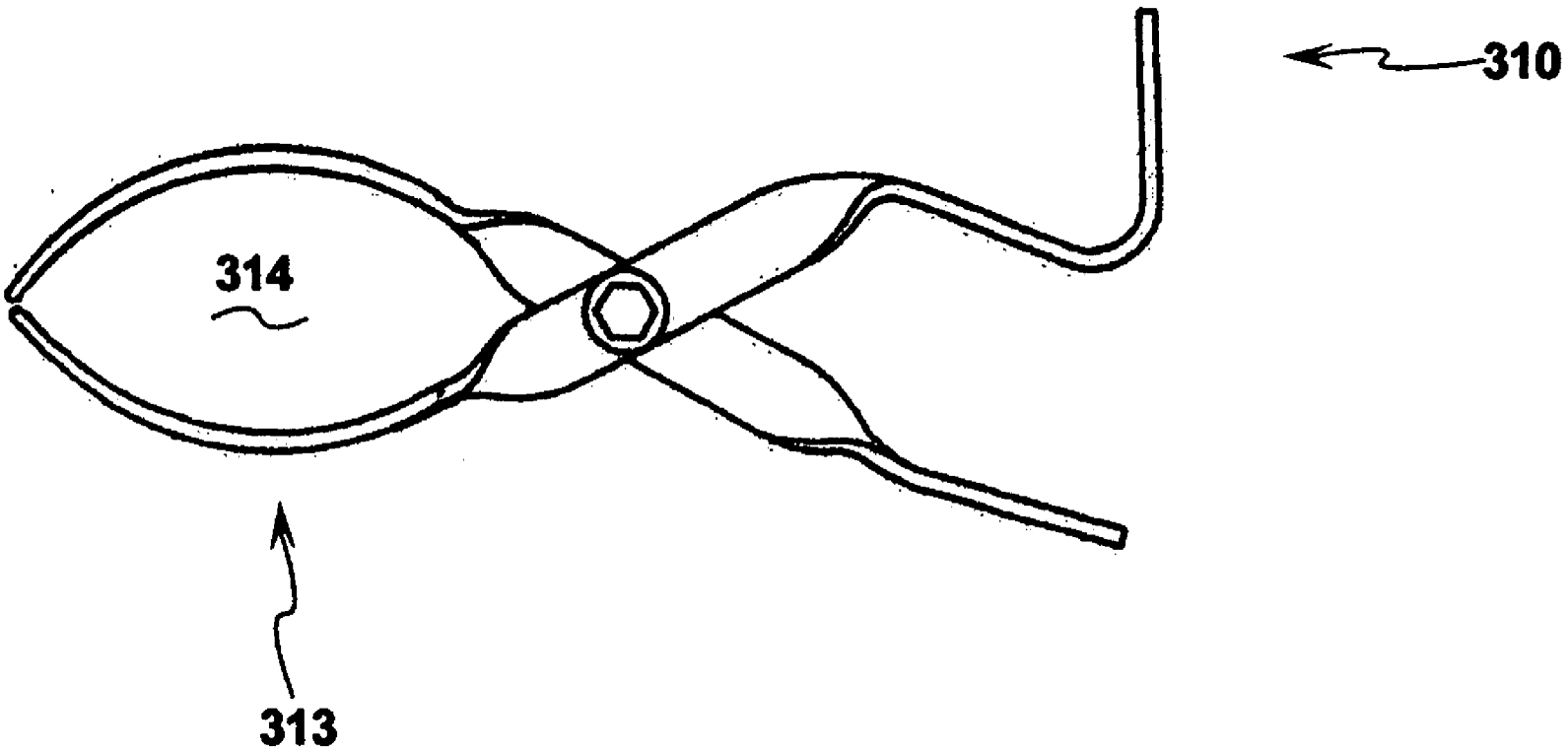
FIG. 12 shows a second embodiment of a tong member that is suited for a larger-diameter projectile.

Now referring to FIG. 11, there is a second embodiment where the base frame 232 has an extension 231 that is rigidly attached to the forward region 268 of the base member 264. In general, the embodiment as shown in FIG. 11 is a longer version in the longitudinal direction 22 to allow for a greater distance to provide acceleration upon the projectile. One form of the embodiment 220 as shown in FIG. 11, is for launching tennis balls which is particularly useful and enjoyable when playing with a dog. Oftentimes, dogs like to play fetch, and a common fetch item is an old tennis ball which dogs in general tend to enjoy retrieving. Therefore, a slightly enhanced tong unit 310 as shown in FIG. 12 can be employed. In general, the tong unit 310 comprises a cradle region 313 that extends further in the longitudinal direction to hold a larger projectile therein. Therefore, positioning a larger projectile such as a tennis ball in the interior chamber region 314 of the cradle region 313 in a similar manner as that as the cradle region 113 as shown in FIG. 3.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

I claim:

1. A projectile launching device adapted to launch a projectile from a shooter comprising:

a) a base frame having a forward region and a stock region positioned in a longitudinally rearward region, b) a propulsion area having a propulsion pocket connected to first and second elastic members, the first and second elastic members in turn being attached to a base support that is fixedly attached to the base frame, c) a surface defining a receiving location positioned in the longitudinally rearward portion of the base frame, d) a tong unit having first and second tong members pivotally attached to one another whereby a longitudinally forward region of the pivot attachment, the first and second tong members defining a cradle region, positioned rearwardly of the pivot attachment is an extension on the second tong member and an engagement and release surface positioned laterally outwardly of the first tong member, the tong unit further comprising a locking member that extends vertically downwardly, e) whereas the locking member is adapted to engage in the receiving location of the base frame whereby the cradle region is adapted to engage the outer surface of the propulsion pocket with the projectile contained therein and the shooter must engage active pressure upon the engagement and release surface of the first tong to maintain the projectile launching device in a stored energy state.

2. The projectile launching device as recited in claim 1 whereby the locking member has a lower surface adapted to engage a lower surface of the receiving location in the base frame so as to establish a consistent set point so the projectile is positioned at a consistent location from shot to shot.

3. The projectile launching device as recited in claim 1 whereby a sighting system is employed with a red dot scope.

4. The projectile launching device as recited in claim 3 whereby the center of the red dot scope is positioned substantially in line with a center axis of the base frame.

5. The projectile launching device as recited in claim 4 whereby a connecting region is adapted to provide a first mounting region to mount the red dot scope thereto, and a second mounting region adapted to rigidly mount to the base frame whereas a central region is positioned laterally outwardly to allow the propulsion pocket to pass freely therethrough.

6. The projectile launching device as recited in claim 1 whereby the base frame is comprised of a base member and a stock region whereby the stock region is fixedly and removably attached to the base member.

7. The projectile device as recited in claim 6 whereby a plurality of openings are provided to adjust the stock region to various longitudinal locations.

8. The projectile launching device as recited in claim 1 whereby the first and second elastic members each comprise two sets of elastic tubing.

9. The projectile launching device as recited in claim 1 whereby a forward handle is provided on the base frame for grasping by the shooter.

10. A method of launching a projectile by a shooter comprising the steps of:

a) positioning a projectile within a pouch where the pouch is operatively connected to first and second elastic members which are attached to a frame, b) positioning a shoulder stock region portion of the frame against the shoulder of a shooter for supporting the frame, c) retracting the pouch with the projectile therein with a containment and release mechanism, d) positioning the containment and release mechanism to the frame so the projectile is at a known position with respect to the base frame, e) orientating the frame to be in a trajectory alignment with a target by aligning the target with a sighting system, f) with active engagement of the containment and release mechanism by the shooter, relinquishing a proactive engagement with the containment and release mechanism thereby releasing the pouch allowing the first and second elastic members to propel the projectile forward toward the target.

11. The method as recited in claim 10 where the containment and release mechanism comprises a downward extending member adapted to engage a receiving location in the frame having an upper surface adapted to engage the downward extending member to provide a consistent positioning of the containment and release mechanism.

12. The method as recited in claim 10 where the sighting system comprises a multi-positional scope that does not require perfect sight alignment by the shooter.

13. The method as recited in claim 12 whereby the containment and release mechanism is comprised of a handle region having two members pivotally attached where a forward portion of the members comprises a tong region whereby a lateral inward pressure in the handle region applies lateral pressure upon the pouch with the projectile therein and active engagement by the shooter is required to maintain pressure upon the pouch to prevent an unintentional discharge of the projectile.

14. A projectile launching device adapted to accelerate a projectile in a controlled fashion toward a target by a shooter, the device comprising:

a) a frame having forward, central and rearward areas and comprising a shoulder stock region positioned in the rearward area and adapted to engage the shoulder region of the shooter, b) a receiving location positioned in the central area of the frame, c) a sighting system positioned in the central area of the frame and providing a diode-concave glass scope not requiring perfect sight alignment of the shooter, d) a propulsion area having a pouch adapted to mount a projectile therein, the propulsion area comprising an elastic propulsion unit having a first end attached to the frame at the forward location, e) a containment and release mechanism adapted to grasp a projectile within the pouch whereby the shooter must engage actively to maintain a hold of the projectile, the containment and release mechanism having an alignment feature adapted to cooperate with the receiving location of the frame to consistently position the pouch with respect to the frame.

15. The projectile launching device as recited in claim 14 whereby the sighting system comprises a sighting frame member having a laterally outwardly bowed region to allow movement of the pouch thereunder when a projectile is fired.

16. The projectile launching device as recited in claim 15 where the stock region is fixedly and removably attached to a forward portion of the frame.

17. The projectile launching device as recited in claim 16 where the elastic propulsion unit is attached to a base support fixedly and removably attached to the forward region of the frame where the sighting frame, stock region and the base support are adapted to be removed for shipment to reduce the dimensions of the projectile launching device.

18. The projectile launching device as recited in claim 17 whereby the frame is provided with a forehand grip adapted to be grasped by the hand of the shooter not clamping the containment and release mechanism.

* * * * *